US007096996B2

(12) United States Patent
Korchagin et al.

(10) Patent No.: US 7,096,996 B2
(45) Date of Patent: Aug. 29, 2006

(54) HIGH-RISE FIRE-FIGHTING, RESCUE AND CONSTRUCTION EQUIPMENT

(75) Inventors: Pavel V. Korchagin, Apt. 81, House 30, Building 1, Beskudnikovsky Blvd., Moscow (RU) 127474; Marina E. Korchagina, Apt. 112, House 5, Second Khoroshevskiy Lane, Moscow (RU) 123007; Vladimir I. Maloletkov, Samara (RU); Igor I. Goldstein, 16776-39th Ave. North, Plymouth, MN (US) 55446

(73) Assignees: Pavel V. Korchagin, Moscow (RU); Marina E. Korchagina, Moscow (RU); Vladimir I. Yudakov, Samara (RU); Igor I. Goldstein, Plymouth, MN (US); Andrey G. Tirskiy, Moscow (RU)

( * ) Notice: Subject to any disclaimer, the term of this patent is extended or adjusted under 35 U.S.C. 154(b) by 262 days.

(21) Appl. No.: 10/205,981

(22) Filed: Jul. 26, 2002

(65) Prior Publication Data

US 2005/0016794 A1 Jan. 27, 2005

(51) Int. Cl.
*E04G 3/00* (2006.01)

(52) U.S. Cl. ..... 182/82; 182/37; 187/239

(58) Field of Classification Search ..... 182/82, 182/36, 37, 141; 187/239
See application file for complete search history.

(56) References Cited

U.S. PATENT DOCUMENTS 3,064,754 A * 11/1962 Broderson et al.
3,997,135 A * 12/1976 Peterson ..... 244/137.1
4,018,306 A * 4/1977 Lyons ..... 182/148
4,098,371 A * 7/1978 Cox ..... 182/2.7
4,485,891 A * 12/1984 Friess ..... 182/9
4,640,384 A * 2/1987 Kucher et al. ..... 182/51
5,286,159 A * 2/1994 Honma ..... 444/728
5,351,783 A * 10/1994 Celli ..... 182/133
5,419,262 A * 5/1995 Turpin, Sr. ..... 105/241.2
5,582,467 A * 12/1996 Drolet et al. ..... 299/33
5,688,323 A * 11/1997 Kane et al. ..... 118/326

FOREIGN PATENT DOCUMENTS

DE 3939762 A1 * 6/1981
GB 2099789 A * 12/1982

* cited by examiner

*Primary Examiner*—Alvin Chin-Shue
(74) *Attorney, Agent, or Firm*—Nikolai & Mersereau, P.A.

(57) ABSTRACT

An elevator for traveling on a rail attached to the outside of a high-rise building supports a telescoping arm for reaching any position on or above the building. A platform attached to the telescoping arm can deliver materials to the building while under construction and thereafter be used for building maintenance such as window washing. The movable platform adjacent a building can take the place of scaffolding for a safer work environment. The telescoping arm may have various attachments for different functions including a cabin for rescuing people trapped in a high-rise during a fire or for positioning fire fighters and hoses or fire fighting equipment next to a fire.

18 Claims, 7 Drawing Sheets

HIGH-RISE FIRE-FIGHTING, RESCUE AND CONSTRUCTION EQUIPMENT

BACKGROUND OF THE INVENTION

1. Field of the Invention

This invention relates generally to a combination elevator and crane for use on high-rise structures. The invention can be used for fire fighting and rescue and can also be used for construction and maintenance of high-rise structures.

2. Description of the Related Art

Currently vertical transportation in high-rise structures is limited to stairs and elevators. Fire fighters on the outside of the building are limited by how high their ladders will reach when fighting fires or attempting rescues. Construction and building maintenance is limited as to access to the outside walls and roof of the building. For example window washing is limited to a plank or precariously dangling from ropes extending from the top of a building. Construction of the building is similarly hampered by the need for scaffolding and lack of easy transportation and access to all areas on the outside of a high-rise building.

SUMMARY OF THE INVENTION

The invention comprises a device having a crane portion and an elevator portion. The elevator portion for traveling vertically up and down the outside of a building and the crane portion for extending an arm to a desired location on the building. The crane portion can support a passenger cabin for fire rescue. It can also have fire-fighting equipment for access to all portions of a building. The crane can also haul building materials to any location of a building under construction and can be used for window washing or other maintenance activities on the outside of the building.

An elevator portion has a telescoping pole for adjusting the distance between to a cabin on the other end of the telescoping pole. The telescoping pole has pivots on both ends, the one attached to the cabin is for keeping the floor of the cabin horizontal. The pivot attached the to elevator portion is to angularly position the cabin relative the elevator portion. A rotating portion on the elevator portion swings the telescoping pole toward or away from the building.

A rail attached to the side of the building is engaged by wheels, which are clamped to the rail and hold the elevator portion in place and propel the elevator portion vertically on the rail. The clamping feature allows the elevator portion to engage or disengage the building. The elevator portion may thus be moved to different portions of the building or transported to different buildings when needed.

A transport vehicle having a telescoping arm, a rotating mechanism and a pivoting mechanism can position the elevator portion adjacent a rail for engagement thereto.

A cabin or platform attached to the telescoping pole on the elevator portion can perform many tasks. It can deliver goods or workers to places on the building during construction. It can also be used for fire fighting and rescuing people from buildings.

OBJECTS OF THE INVENTION

It is an object of the invention to provide vertical and horizontal transportation to the outside surface or roof of a building.

It is an object of the invention to transport fire-fighting equipment at any point on the outside of a building.

It is an object of the invention to rescue people from buildings during fires or other emergencies.

It is an object of the invention to transport construction materials to any part of a building under construction.

It is an object of the invention to provide a platform for construction or maintenance personnel for working on a building.

It is an object of the invention to provide a transportable fire fighting and rescue system to high-rise structures.

Other objects, advantages and novel features of the present invention will become apparent from the following description of the preferred embodiments when considered in conjunction with the accompanying drawings.

DESCRIPTION OF THE PREFERRED EMBODIMENTS

Figure 1A:
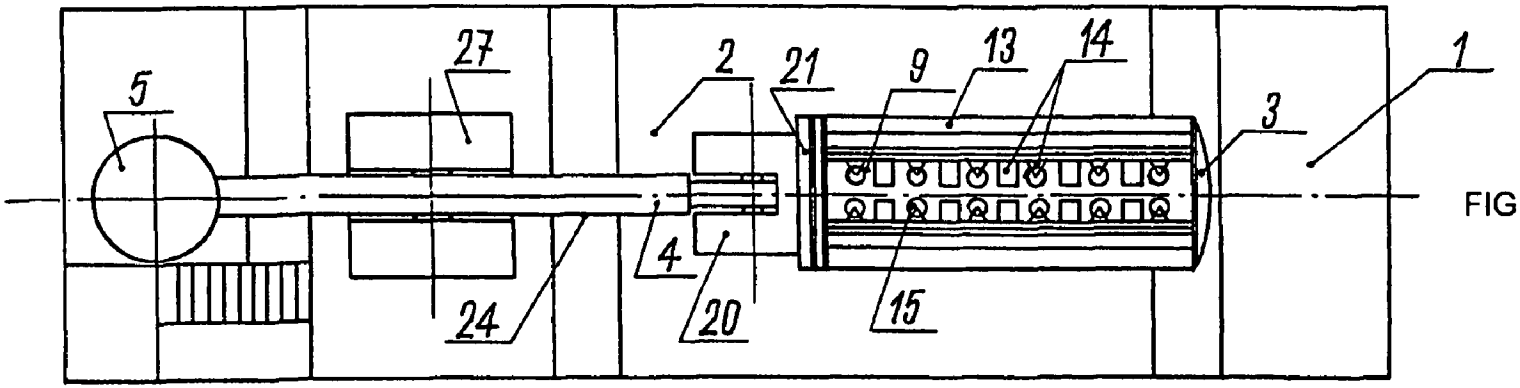
FIG. 1A shows a top view of the invention shown in FIG. 1.
Figure 1:
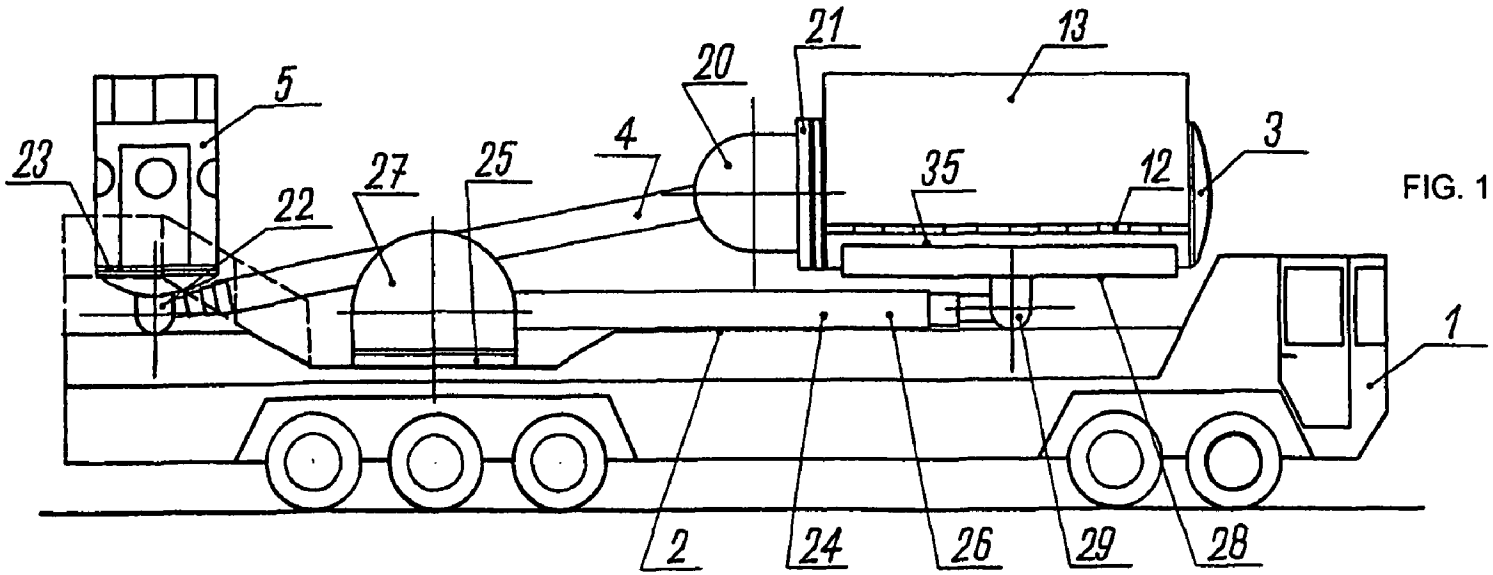
FIG. 1 shows a side view of the invention on a vehicle.
Figure 2:
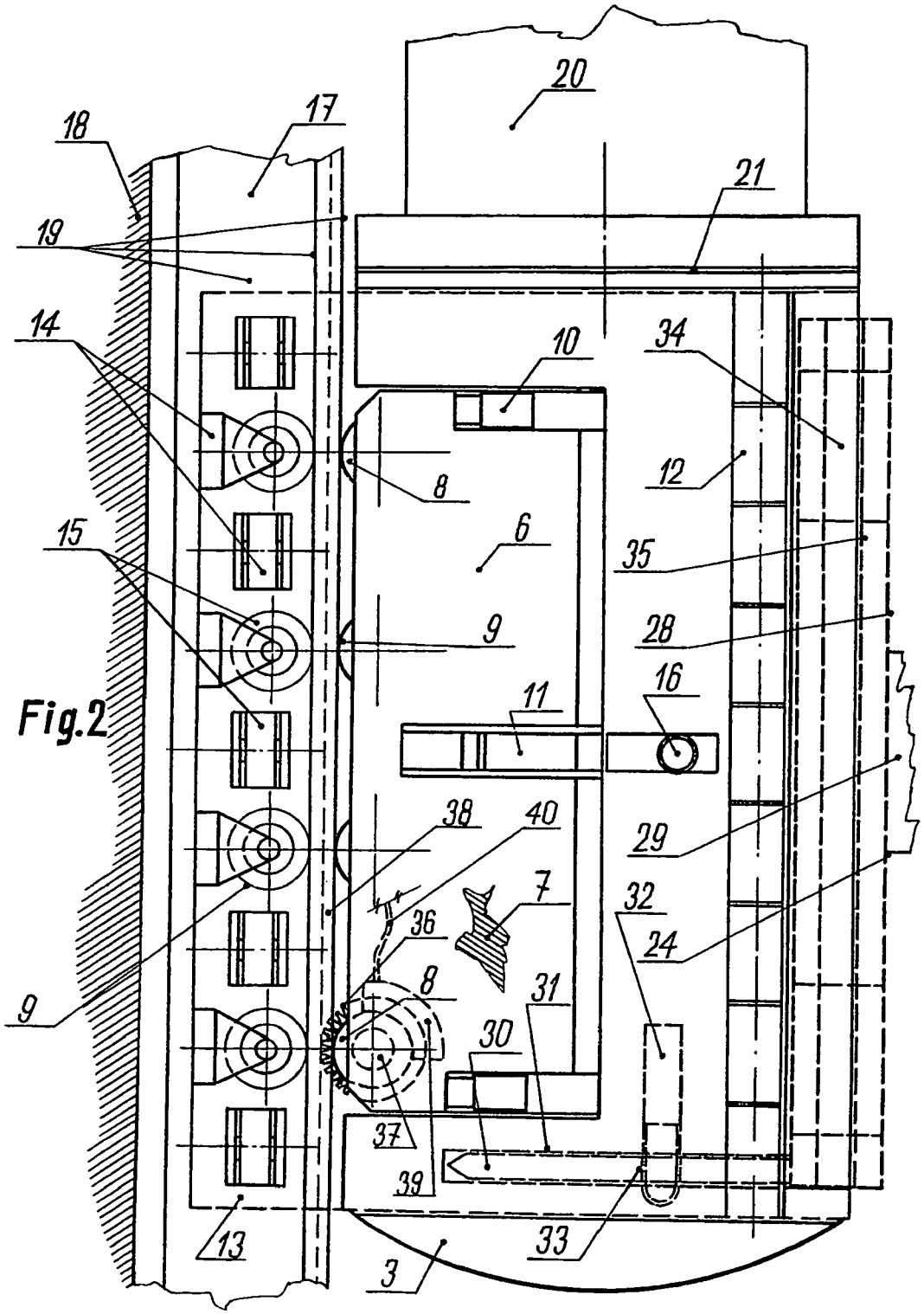
FIG. 2 shows a side cut a way view of a self-propelled unit deployed on an H-beam rail.
Figure 3:
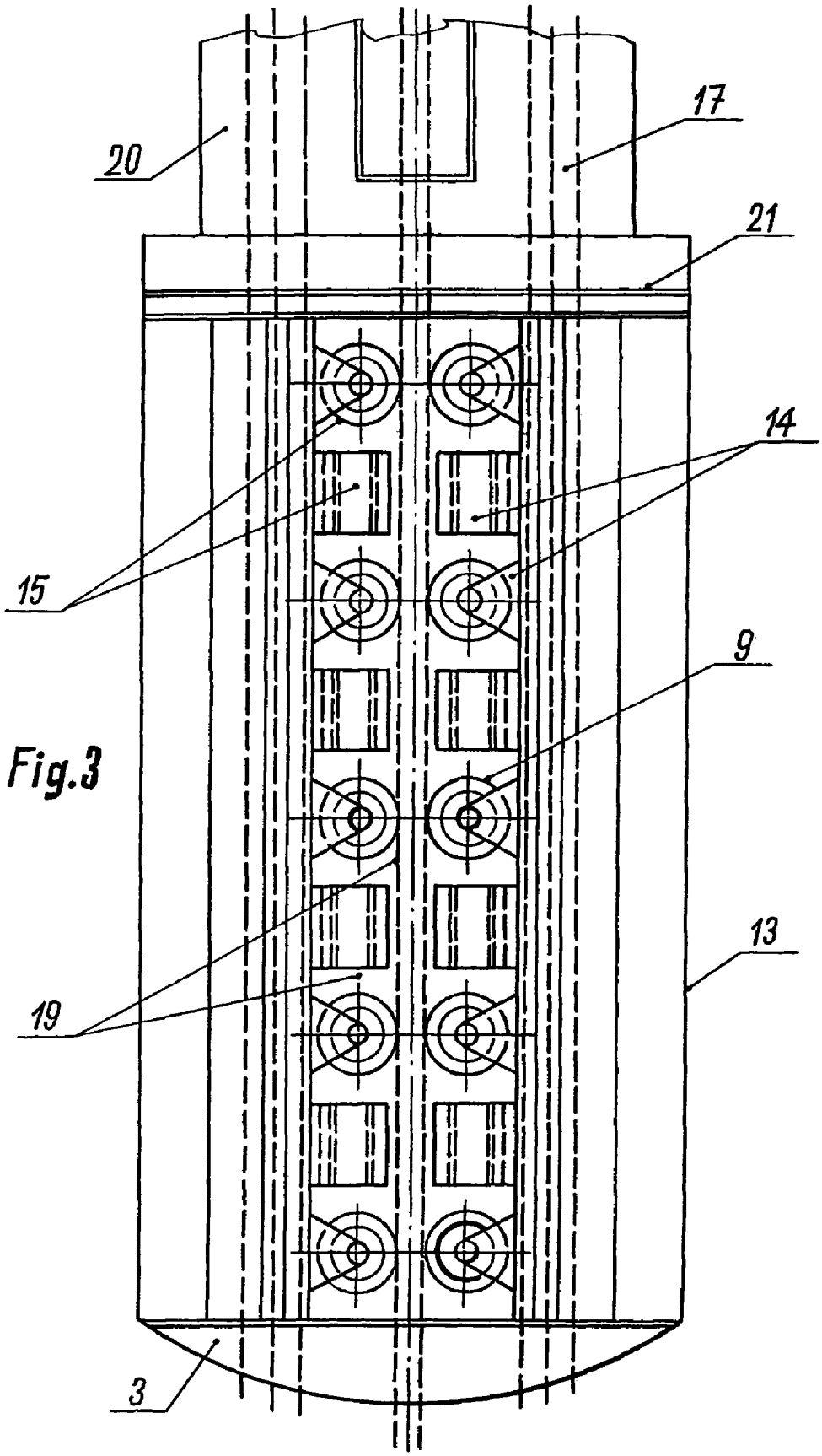
FIG. 3 shows a front view of the self-propelled unit deployed on an H-beam rail.
Figure 4:
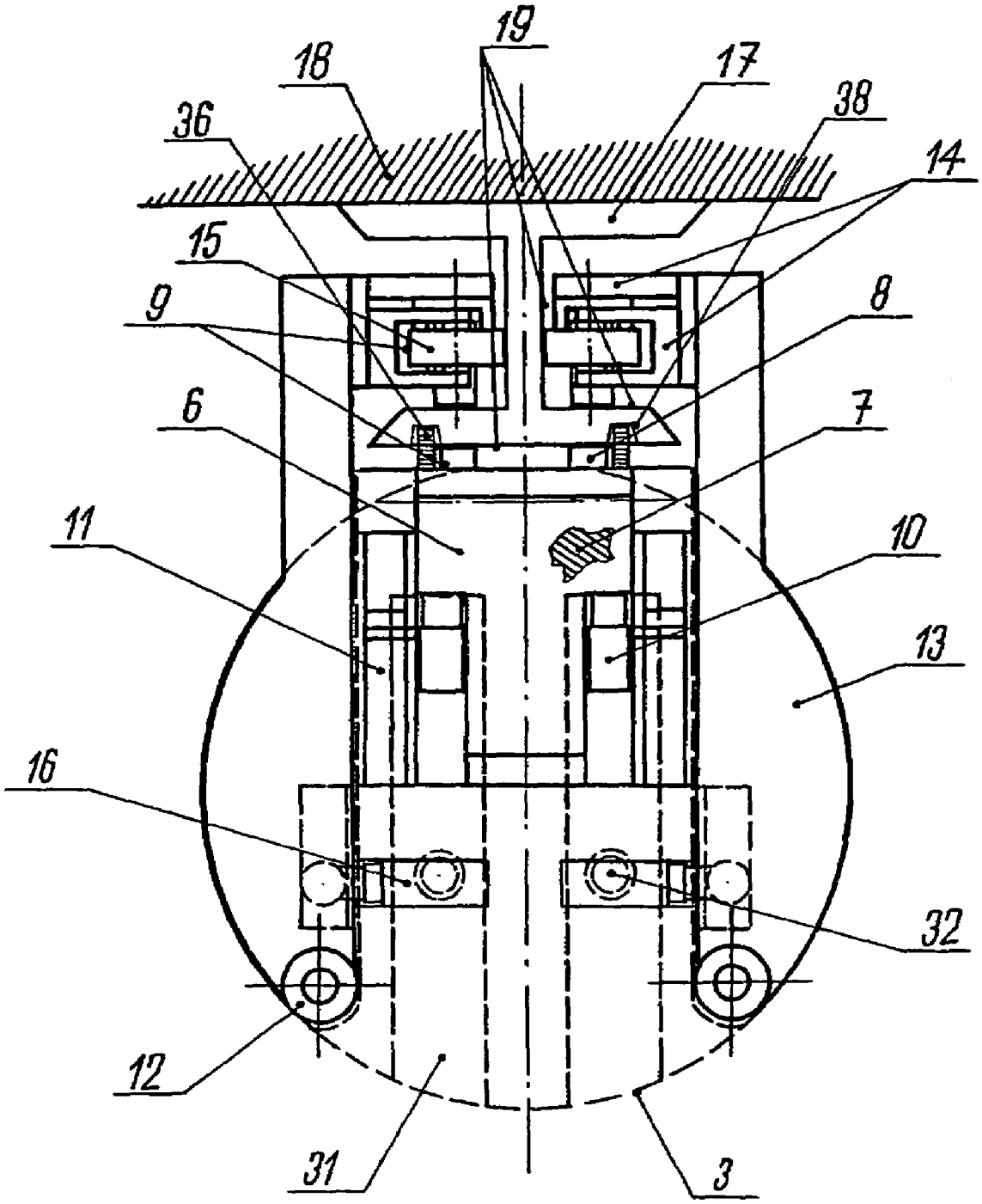
FIG. 4 shows a top view of the self-propelled unit deployed on an H-beam rail.
Figure 5:
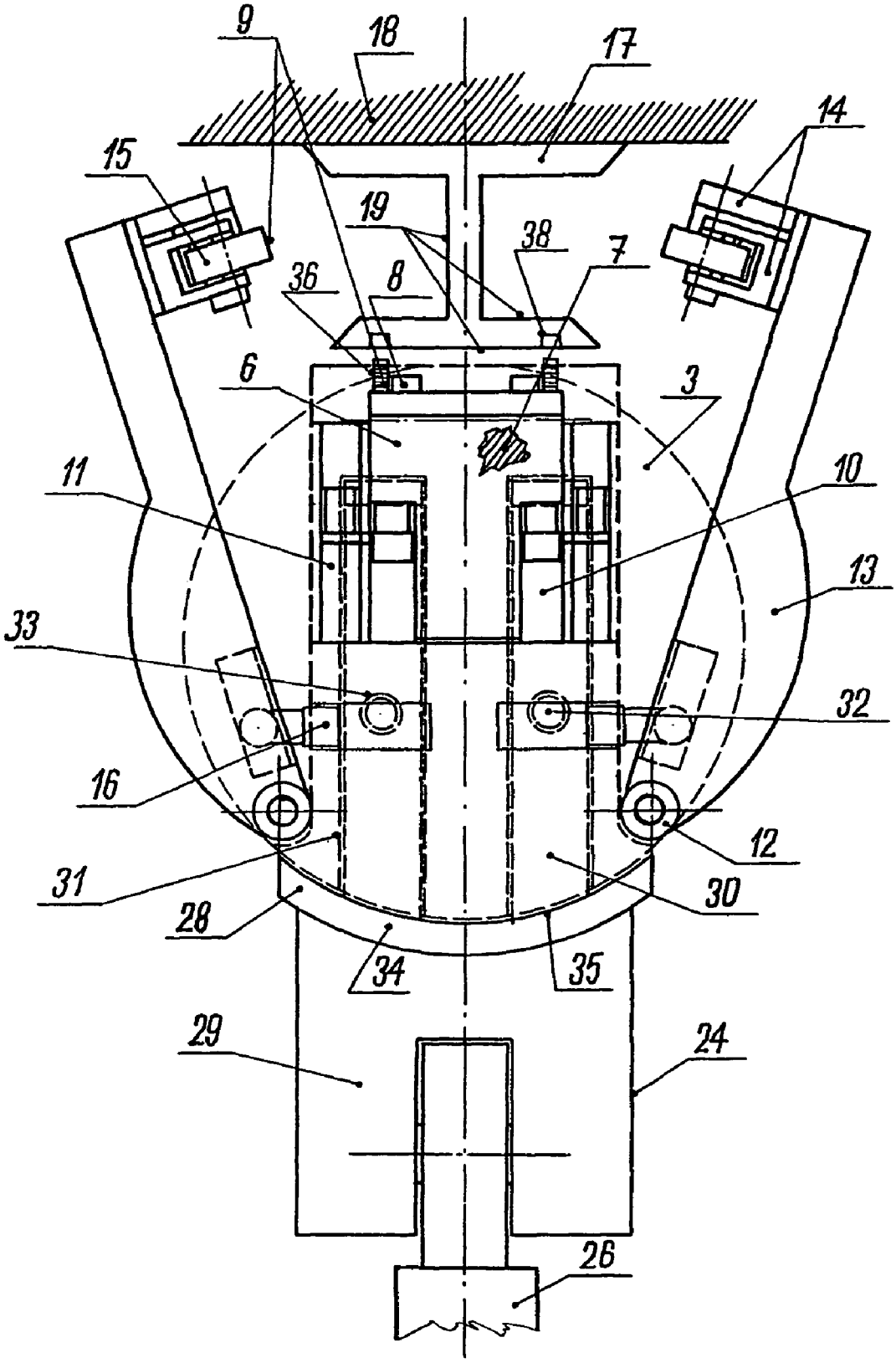
FIG. 5 shows a top view of the self-propelled unit at the time of installation on H-beam rail.
Figure 6:
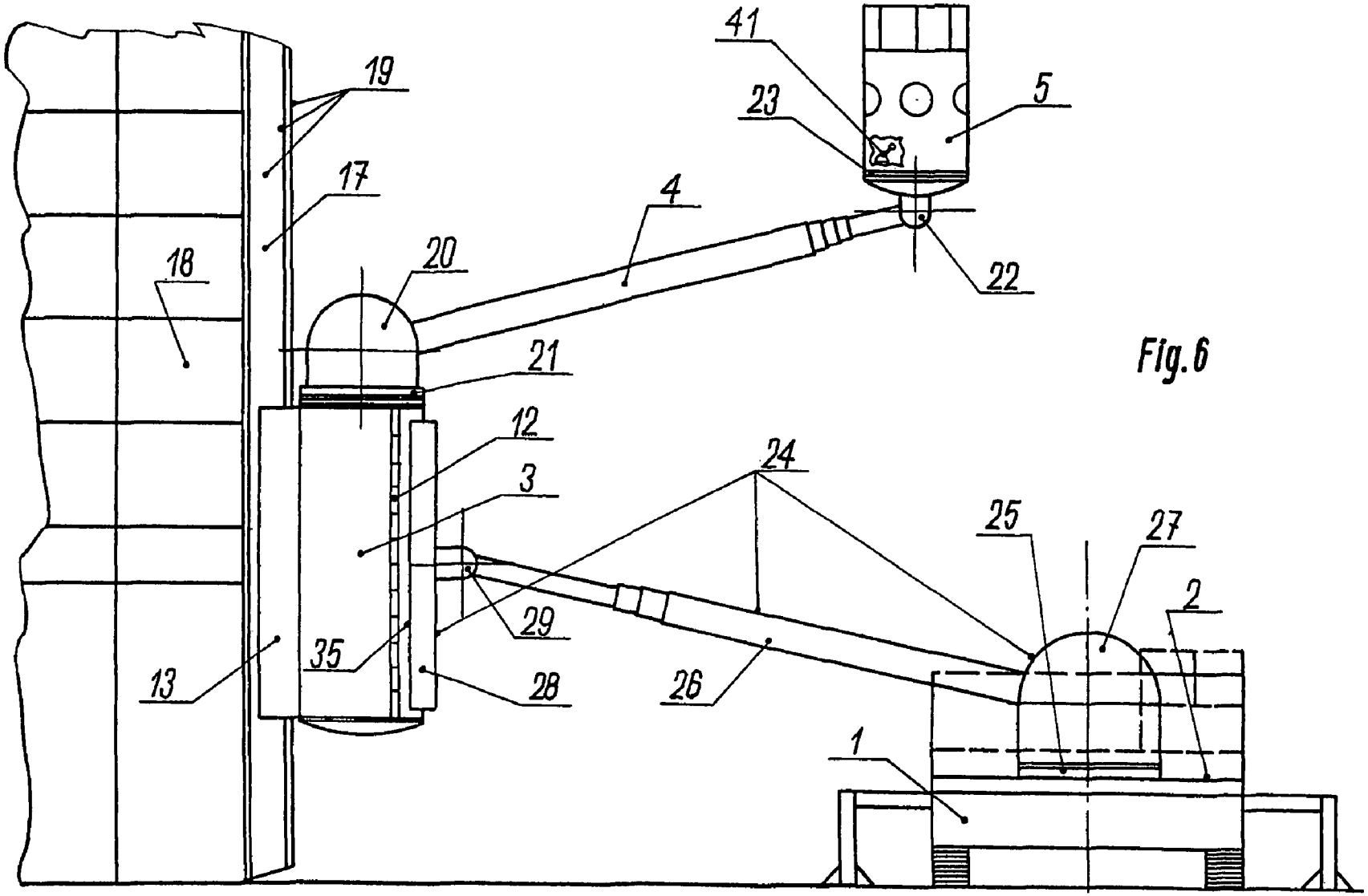
FIG. 6 shows process of installing the self-propelled unit on H-beam rail.

The invention comprises a device having an elevator portion 3 for riding vertically on a rail 17 attached to or part of a building 18. The elevator portion 3 has a crane portion having a telescoping arm 4 connecting it to a cabin 5. The telescoping arm is rotationally connected to the elevator portion 3 by rotating mechanism 21 and pivotally connected by pivoting mechanism 20, such that the cabin 5 can be moved to anyplace adjacent the building 18 and held upright by pivoting mechanism 22. The cabin 5 can be rotated by rotation mechanism 23 to position a fire hose in any direction or place a door next to the building 18.

Figure 7:
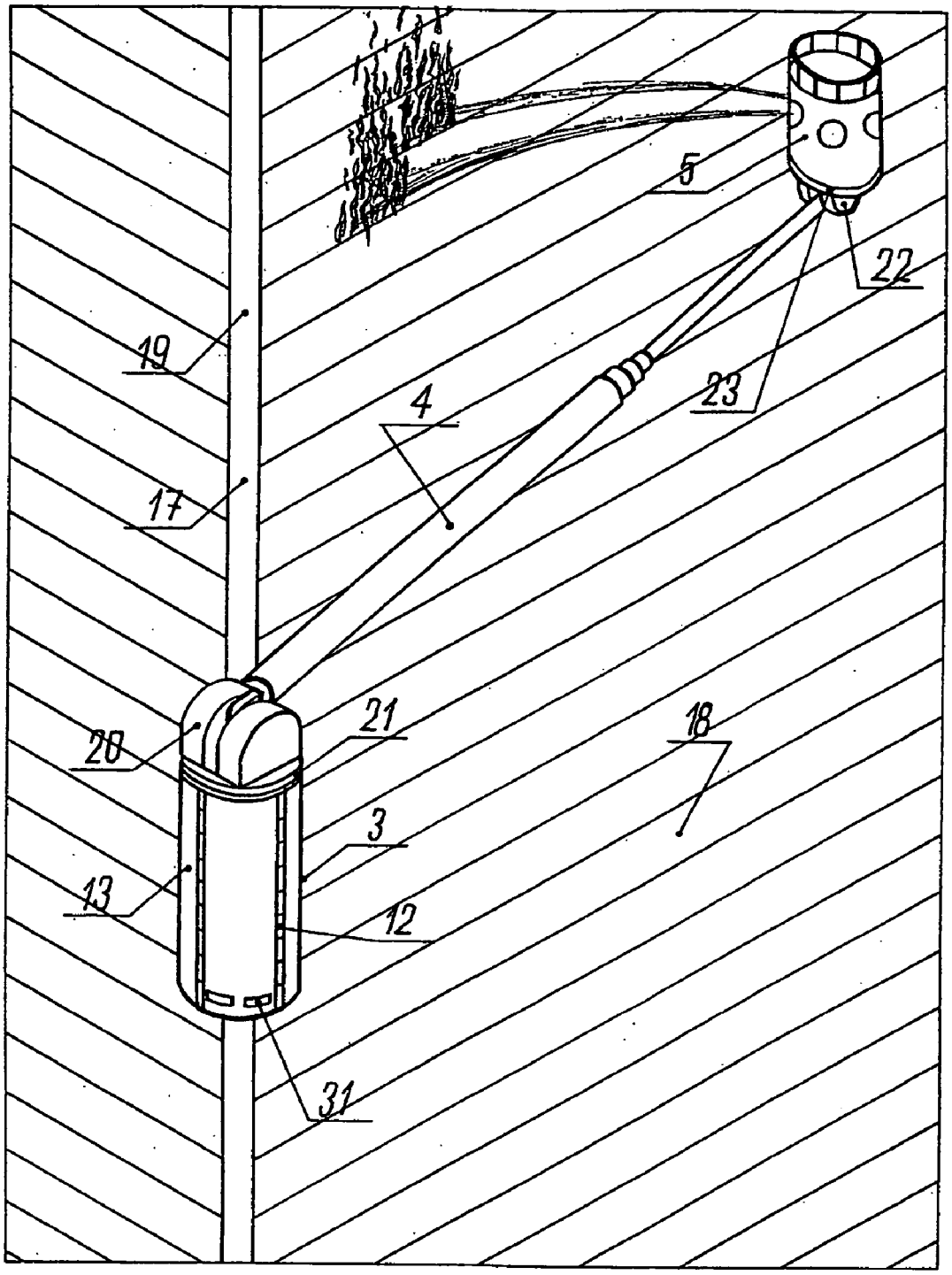
FIG. 7 shows the self-propelled unit supporting a fire-fighting system.

As shown in FIG. 7 the elevator portion is riding on rail 17 on building 18 and the cabin 5 is equipped with fire extinguishing equipment. The cabin 5 can be of many different types for different uses. As a fire fighting cabin it can have fire hoses, heat sensors, and insulated fire resistant walls. The cabin 5 may have a door adjacent the building for effecting rescues and evacuating people trapped in high-rise buildings. The cabin may also be a working platform for workers to stand in during construction of a building. The cabin 5 can also be replaced by a platform or support device like a hook for hauling materials up a building during construction. Such a device would be useful for installing or cleaning windows or installing paneling or maintaining on the outside of buildings.

The rail 17 on the side of building 18 can be an I beam, an H shaped rail, a pole, or any other support. The rail 17 can have a high friction surface 19 for engaging wheels 15 in the elevator portion 3.

As shown in the figures the an H shaped rail 17 having a frictional surface 19 is engaged by wheels 15 having elastic tires 9 for gripping the rail 17 on the connecting center portion of the H shape to prevent left to right movement on the rail relative to the building 19. The wheels are supported on frames 14 attached to spreadable arms 13. The arms 13 pivot on hinge 12 and are opened or closed by moving pistons 16. When arms 13 are opened the elevator portion 3 can be removed from the H shaped rail 17. When the arms 13 are clamped closed on the H shaped rail 17 the elevator portion 3 is attached to the rail 17. The back of the H shaped rail is attached to the building 18.

With the elevator portion 3 attached to the rail 17 additional wheels 9 on the spread arms 13 rotated 90 degrees to the first set of wheels 8 have tires 9 to engage the inside surface of the top of the H shaped rail 17. Additional wheels 8 with tires 9 engage the outside surface of the top of the H shaped rail 17. The wheels 8 on the inside and outside of the top of the H shaped rail 17 are pressed together by a jack device 16 engaging telescoping beam 10 to push the engine compartment 7 and its attached wheels 9 against rail 17. An engine compartment 7 has an engine or electric motor for providing power to the wheels 8 attached for propelling the elevator portion 3 along the rail 17.

Guides 38 indented in the rails 17 engage wheels such as cogwheels 36, which engage apertures in the rail 17 to grippingly engage the rail. A brake 37 can be used for stopping the elevator portion 3 in emergencies by pulling on emergency break 41 in cabin 5, connected to brake cable 40. In some embodiments the cogwheels 36 can be used as the drive wheels.

It is contemplated that the elevator portion 3 will at least be moved to elected rails 17 for use on the building 18 for reaching different positions and performing different tasks. It is therefore desirable to have a vehicle for moving the elevator portion around. In one embodiment a fire fighting cabin 5 attached to the elevator portion can be transported on a specialized fire truck.

The vehicle will have a chassis 1 and a top surface 2 to support a loading mechanism 24 comprising a telescoping pole 26 pivoting mechanisms 27, 29 and rotating mechanism 25. Rotating mechanism 25 is rotatingly attached to the chassis 1 and has a pivoting mechanism 27 attached which supports telescoping arm 26. The opposite end of telescoping arm 26 has a pivoting mechanism 29 attached to back holding support 28 for holding the elevator portion 3. With the chassis 1 driven to location adjacent the building 18 and the rail 17 attached thereto the elevator can be swung into position by a combination of movements of the telescoping pole 26, the rotating mechanism 25 and the pivoting mechanisms 27 and 29 and attached to the rail 17.

The back holding support 28 has fork elements 30 for engaging slots 33 in the elevator portion 3 for lifting elevator portion 3 and for engaging and disengaging by use of jacks 32 engaging the fork elements 30. Optionally electromagnets 34 in slots 35 of back holding support 28 can engage magnetic material on the elevator portion to help hold the elevator portion 3 on the back holding support 28.

Although the specification discloses telescoping arms any type of arm may be used such as a rail and a wheel arrangement in order to have a movement along the arm.

The cabin can be manned or unmanned. Fire fighting equipment can be remotely controlled from the ground. Sensors, cameras, microphones, smoke detectors and other devices in the cabin can be used to help locate fires from the outside of the building and rescue people trapped therein.

The rail being on the outside of the building affords transportation on the outside of the building away from flames and smoke. The cabin can be swung away from the building in danger zones. The cabin can be positioned adjacent the sides of a building or over the top of a building.

Although the elevator portion has been shown with engines or motors inside, a cable system or hydraulic system can be used to transport the elevator portion up the rail attached to the building. Further other means of attaching the elevator portion to the building other than rails with wheels for engaging the rails are within the scope of the invention.

Obviously, many modifications and variations of the present invention are possible in light of the above teachings. It is therefore to be understood that, within the scope of the appended claims, the invention may be practiced otherwise than as specifically described.

What is claimed is:

1. An elevator crane comprising, an elevator car having at least one power driven wheel with a tire for engaging a first side of a flat surface on a vertical rail attached to a structure, at least one moveable support arm having a vertical frame with a plurality of wheels, the wheels arrayed alone the vertical frame and alternating perpendicular to each other along the frame with wheels having axles parallel and perpendicular to the length of the arm, the wheels with a tire, the support arm extending from the elevator car for engaging a second side flat surface side of the vertical rail, opposite the first side, for releasably attaching the elevator car to the rail and providing opposing force on the wheels engaging the rail to secure the elevator car to the rail with enough force to allow the elevator car to be supported by the wheels and moved vertically by the force of the at least one power driven wheel with the tire engaging the rail, the perpendicular wheel engage the rail for lateral support on a perpendicular surface of the rail perpendicular to the first surface, a crane attached to the elevator car.

2. An elevator crane as in claim 1 wherein, the crane portion has an arm, with a rotating mechanism and a pivoting mechanism for supporting the arm at one end, a pivot mechanism attached to the arm at a second end, a platform attached to the pivot mechanism at a second end of the arm.

3. An elevator crane as in claim 2 wherein, the arm comprises a telescoping arm.

4. An elevator crane as in claim 2 wherein, a cabin attached to the platform.

5. An elevator crane as in claim 4 having, fire fighting equipment carried in the cabin for fighting fires.

6. An elevator crane as in claim 4 wherein, a fireproof material used on the cabin to prevent the cabin from catching on fire.

7. An elevator crane as in claim 1 wherein, a jack for drawing the wheel on the support arm toward the elevator car on the rail.

8. An elevator crane as in claim 7 wherein, an emergency brake attached to the elevator car for stopping the elevator from descending in an emergency.

9. An elevator crane as in claim 1 wherein, a transport vehicle has an elevator car delivery and retrieval mechanism to hold the elevator car adjacent the rail for attachment to or release therefrom.

10. An elevator crane as in claim 9 wherein, the elevator car delivery and retrieval mechanism has a rotating mechanism attached to the transport vehicle, a pivoting mechanism attached to the rotating mechanism, a telescoping pole, and a second pivoting mechanism attached between the telescoping pole and the elevator car such that the elevator car can be positioned adjacent the rail.

11. An elevator crane as in claim 4 wherein, a door in the cabin, the cabin having a volume with a capacity to transport people from the building to rescue them from fires.

12. An elevator crane as in claim 7 wherein, a jack on the support arm pulls the wheels on the support arm toward one side of the rail toward the other side of the rail to secure the elevator to the rail by the wheels on another support arm for positioning adjacent to the support arms.

13. An elevator comprising, an elevator car having wheels attached to the car for engaging a first flat surface side of a rail attached to a building, the rail having a second flat surface side opposite the first flat surface side, a pair of arms having vertical frames with a plurality of wheels with alternately perpendicularly facing axles along the length of the vertical frame, the arms pivot to position one set of wheels on a portion of the rail opposite the wheels on the elevator car, and another set of wheels perpendicular to the one set of wheels on the rail perpendicular to the flat surfaces, a jack for moving the arms and increasing or decreasing the relative distance of the wheels on the elevator to the wheels on the arms such that the wheels on the arms and the wheels on the elevator can tightly engage the rail on opposite sides thereof when desired, a motor in the elevator car and a means to transmit power to the wheels on the elevator car for propelling the elevator on the rail.

14. An elevator as in claim 13 comprising, a crane attached to the elevator car, the crane having a platform for positioning in desired locations.

15. An elevator as in claim 14 comprising, a telescoping arm on the crane for moving the platform.

16. An elevator as in claim 14 comprising, a cabin on the platform.

17. An elevator as in claim 13 comprising, a transport vehicle for transporting the elevator to the rail, a crane having a rotating mechanism attached to the transporting vehicle, a pivoting mechanism attached to the rotating mechanism, a telescoping pole attached to the pivoting mechanism, a second pivoting mechanism attached to the telescoping pole, and an elevator holding device to hold and move the elevator attached to the second pivoting mechanism so as to place the elevator adjacent the rail for attachment thereto or removal therefrom.

18. An elevator crane comprising, an elevator car having wheels with tires for engaging and propelling the elevator car vertically on a rail having a flat surface for engaging the tires, attached to a structure, the elevator car having arms with vertical frames with a plurality of alternatingly facing wheels along the length of the vertical frame, the wheels being perpendicular to each other with one set of wheels engaging the rear of the flat surface of the rail, the wheels perpendicular to the one set of wheels engaging the rail perpendicular to the flat surface, a crane portion attached to the elevator car for positioning a platform adjacent the structure.

* * * * *